US005220334A

United States Patent [19]

Raguenet et al.

[11] Patent Number: 5,220,334

[45] Date of Patent: Jun. 15, 1993

[54] MULTIFREQUENCY ANTENNA, USEABLE IN PARTICULAR FOR SPACE TELECOMMUNICATIONS

[75] Inventors: Gérard Raguenet, Portet sur Garonne; Régis Lenormand, Toulouse, both of France

[73] Assignee: Alcatel Espace, Courbevoie, France

[21] Appl. No.: 309,760

[22] Filed: Feb. 13, 1989

[30] Foreign Application Priority Data

Feb. 12, 1988 [FR] France ..... 88 01697

[51] Int. Cl.[5] ..... H01Q 1/38; H01Q 5/01; H01Q 21/29

[52] U.S. Cl. ..... 343/700 MS; 343/727; 343/793

[58] Field of Search ..... 343/700 MS File, 725, 343/727, 729, 730, 829, 830, 846, 895, 794, 793

[56] References Cited

U.S. PATENT DOCUMENTS

| | | | |
|---|---|---|---|
| 4,089,003 | 5/1978 | Conroy | 343/700 MS File |
| 4,118,706 | 10/1978 | Kerr | 343/700 MS File |
| 4,162,499 | 7/1979 | Jones et al. | 343/700 MS File |
| 4,644,361 | 2/1987 | Yokoyama | 343/700 MS File |
| 4,684,953 | 8/1987 | Hall | 343/729 |
| 4,742,359 | 5/1988 | Ishino et al. | 343/895 |
| 5,099,249 | 3/1992 | Seavey | 343/830 |

FOREIGN PATENT DOCUMENTS

| | | | |
|---|---|---|---|
| 188345 | 7/1986 | European Pat. Off. | 343/700 MS File |
| 1221694 | 7/1966 | Fed. Rep. of Germany | 343/727 |
| 2629502 | 1/1978 | Fed. Rep. of Germany . | |
| 25654 | 2/1979 | Japan | 343/727 |
| 107610 | 7/1982 | Japan | 343/700 MS File |
| 29203 | 2/1983 | Japan | 343/700 MS File |
| 2180407 | 3/1987 | United Kingdom . | |

OTHER PUBLICATIONS

Patent Abstracts of Japan, vol. 9, No. 178 (E-330) (1901) Jul. 23, 1985, English Abstract of JP-A-6-0-51008.

*Primary Examiner*—Michael C. Wimer
*Attorney, Agent, or Firm*—Sughrue, Mion, Zinn, Macpeak & Seas

[57] ABSTRACT

The present invention relates to a multifrequency antenna comprising a microstrip patch first antenna (10, 11, 12) operating at one or more frequencies, and a second antenna (17) disposed in front of the antenna and using the same radiating surface and operating at a different frequency. The invention is applicable, in particular, to space telecommunications.

3 Claims, 3 Drawing Sheets

MULTIFREQUENCY ANTENNA, USEABLE IN PARTICULAR FOR SPACE TELECOMMUNICATIONS

FIELD OF THE INVENTION

The invention relates to a multifrequency antenna, usable in particular in space telecommunications.

BACKGROUND OF THE INVENTION

Current trends in telecommunications satellites are towards a general increase in capacity: with each satellite being required, for economic reasons, to be capable of embarking a plurality of payloads. In general, it can be said that the increase in traffic capacity requires very high gain antennas to be used for reasons of data throughput.

In addition, each mission has its own details concerning the following characteristics:

frequency band;

coverage; and general radio performance (gain, space decoupling, etc.).

In the sense of putting them on a common satellite body, it is not possible to increase the number of large antennas (of diameter greater than about 2 meters).

In general, regardless of whether the array operates by direct radiation or by a reflector antenna, it is advantageous to be able to use a common radiating surface. This tends towards maximum integration of functions and improved utilization of surfaces.

The object of the invention is to satisfy such a requirement.

SUMMARY OF THE INVENTION

To this end, the invention provides a multifrequency antenna comprising a microstrip patch first antenna operating at one or more frequencies, the antenna being characterized in that it includes a second antenna disposed in front of the first antenna, using the same radiating surface, and operating at a different frequency.

Advantageously, the first antenna is constituted by a ground plane and a dielectric substrate on which a metal track is deposited, and the second antenna is a wire type antenna which passes through the first antenna via a through hole passing through the center of symmetry of the metal track, with the ground plane seen by the wire antenna being constituted by the metal track as well as by the general ground plane of the printed antenna.

In a first embodiment, the first antenna is a plane antenna and the second antenna is constituted by a coaxial cable terminated by a dipole.

In a second embodiment, the first antenna is a plane antenna and the second antenna is constituted by a coaxial cable terminated by a helix.

BRIEF DESCRIPTION OF THE DRAWINGS

The characteristics and advantages of the invention further appear from the following description given by way of non-limiting example and with reference to the accompanying figures, in which.

DESCRIPTION OF THE PREFERRED EMBODIMENTS

The invention consists in associating at least two radiating elements on a common surface from which they project, with the elements operating in accordance with two different principles;

radiation achieved by "cavities" thus constituting a microstrip patch type antenna; and wire type radiation, thus constituting a radiating dipole or helix.

A two-frequency antenna in accordance with the invention makes it possible to obtain radiation at one frequency using a microstrip patch antenna on a common working surface with radiation at another frequency being obtained by means of a wire antenna. The operating independence of these two antennas makes it possible to optimize them at different frequencies. Decoupling between these two elements is ensured by the fact that the principles which contribute to their radiation are different in nature.

Figure 1:
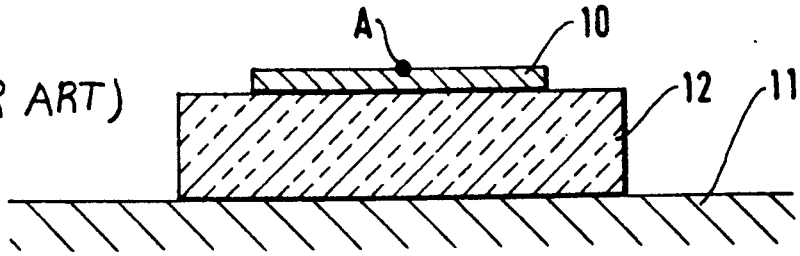
FIG.1 (PRIOR ART)
FIGS. 1 and 2 are two section views through prior art antennas.
Figure 2:
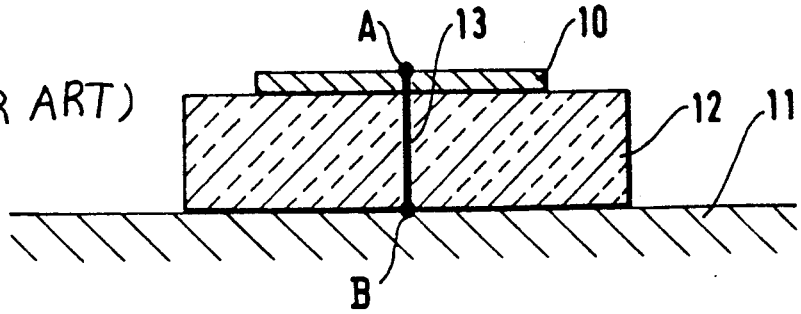
FIG.2 (PRIOR ART)

Numerous authors have described the principles of, ad how to calculate radiation from a microstrip antenna as shown in FIGS. 1 and 2, and comprising a ground plane 11, a dielectric substrate 12, and a metal track 10 (see in particular the article by R. Mosig and E. Gardiol entitled "Rayonnement d'une antenna microruban de forme arbitraire" "i.e. Radiation from a microstrip antenna of arbitrary shape" published in Ann. Telecommun. 40, No. 3–4, 1985, pp. 181–189).

When using square or circular shaped elements, it is observed that the central point A of the top microstrip patch track top conductor 10 (where its two axes of symmetry intersect) is at the same potential as the bottom ground plane 11, as shown in FIG. 1.

There is thus no change in the characteristics (matching, radiation) between a nominal printed antenna and a microstrip patch antenna whose top conductor is connected to the ground plane 11 (AB) via a metal stub 13 as shown in FIG. 2.

According to the invention, a wire antenna is disposed on microstrip patch antenna by making use of this property.

Such an implementation has the following characteristics;

the wire antenna does not alter the matching and radiation characteristics of the microstrip patch antenna; and by virtue of their different radiation principles, coupling between the two elements remains very low.

Several types of wire antenna may be envisaged for installation on the printed antenna. The particular choice will depend on optimization relative to requirements, and appropriate solutions may be constituted by dipoles, single wire helices, four-wire helices, . . . Such wire type antennas have been studies for many years (see in particular, the manual by Richard C. Johnson and Henmry Jasik entitled "Antenna Engineering Handbook", published by McGraw-Hill Book Company, New York). The methods of calculation given in this book, in particular, rely on assumptions about the nature of the currents set up in the conductors in order to evaluate the radiation integral.

In nominal operation (without the microstrip patch antenna) the wire element is placed at an appropriate distance in front of the ground plane. The resulting radiation may be estimated for a dipole structure, e.g. by means of the image principle. There is no significant change in the performance of the wire antenna located over a microstrip patch antenna since the ground plane seen by the wire antenna is constituted by the combination of the microstrip patch conductor and the general ground plane of the microstrip patch antenna. Since the operating frequency of the wire antenna does not correspond to resonance in the microstrip patch antenna, the microstrip patch antenna does not play any special role (field concentration, cavity, resonance). It is nevertheless necessary to change the height of the dipole a little in order to optimize the resulting radiation pattern.

Figure 3:
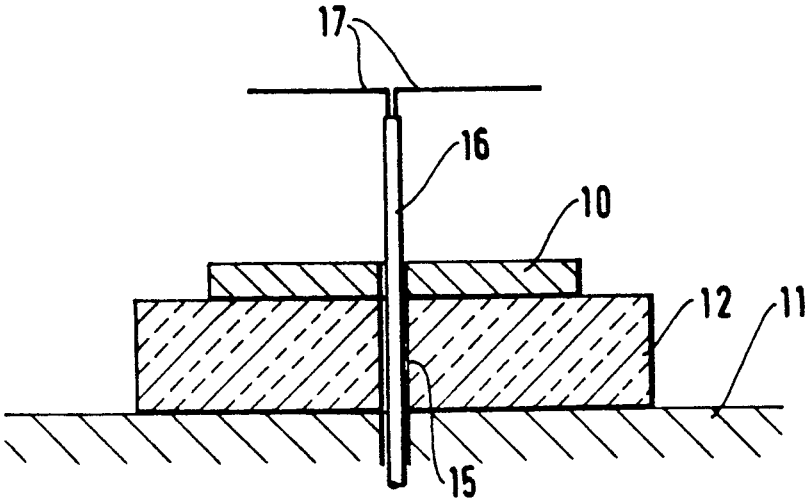
FIG. 3 is a section view through another embodiment of an antenna in accordance with the invention.

In one embodiment, as shown in FIG. 3, there is: a plane microstrip patch antenna having a top conductor 10 as shown in FIG. 2 with a central through hole 15; and a coaxial cable 16 passing through the hole 15 perpendicularly to the plane of the microstrip patch antenna, with the cable being terminated at its free end by means of a dipole antenna 17.

In the embodiment shown in FIG. 3, the dielectric substrate is a few millimeters thick and the track is in the form of a square having a side of about 60 mm.

Figure 5:
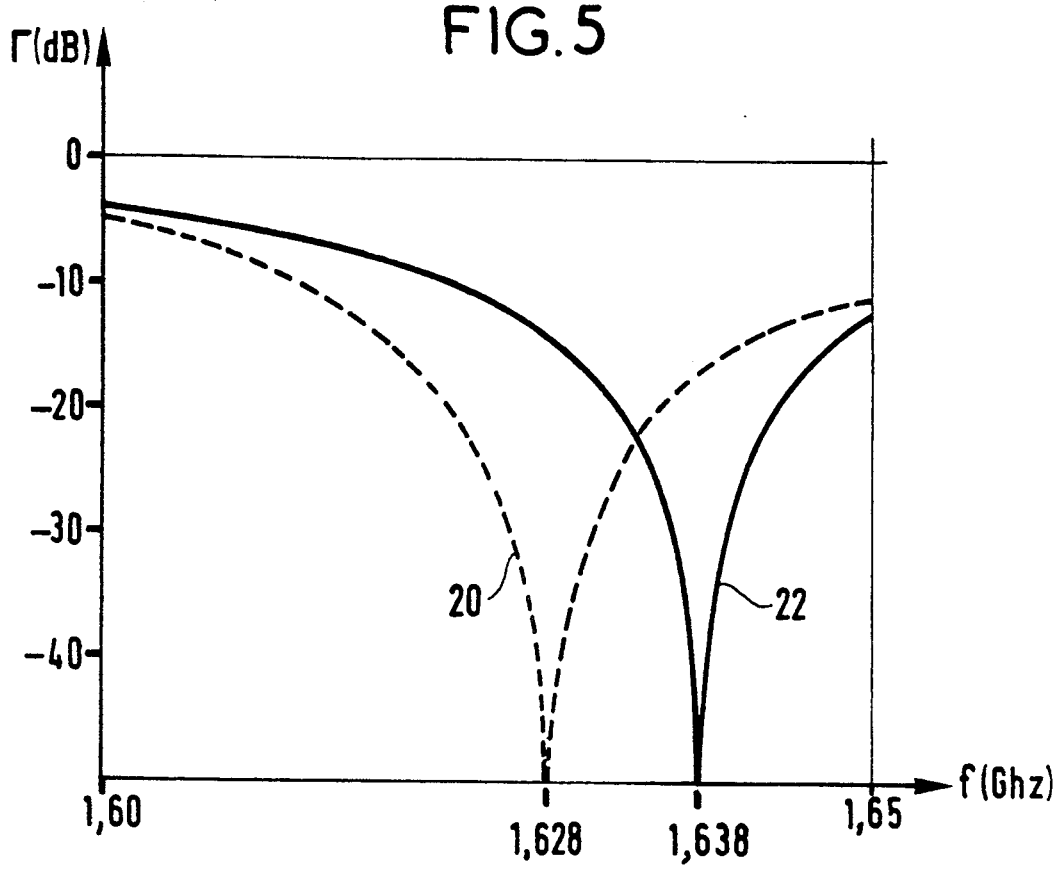
FIGS. 5 and 6 are characteristic curves showing reflection loss as a function of frequency and relating to the embodiment shown in FIG. 3.
Figure 6:
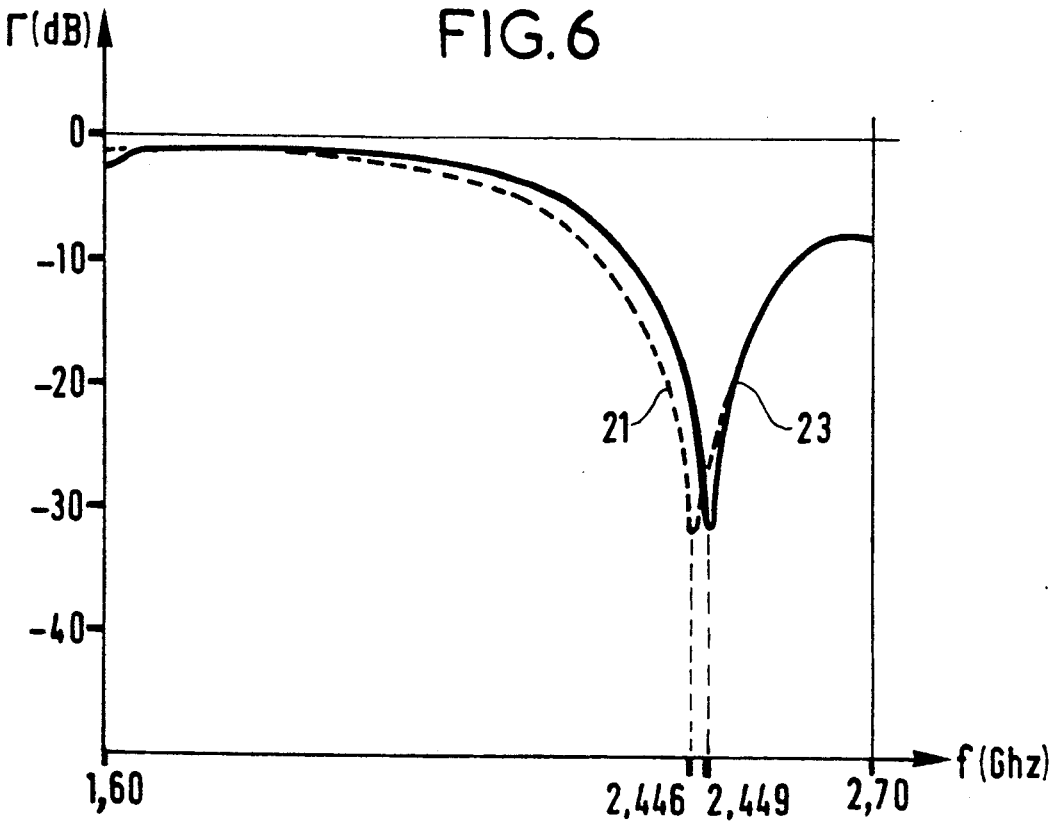

In nominal operation:

the microstrip patch antenna has a resonant frequency at 1628 MHz (see curve 20 in FIG. 5) and the following matching band widths:

to −10 dB: 31 MHz to −15 dB: 26 MHz;

the single dipole is defined at 2449 MHz (see curve 21 in FIG. 6) and has the following matching bandwidths:

to −10 dB: 227 MHz to −15 dB: 110 MHz.

In two-band operation, these results are degraded very little and measurements have provided the following figures:

for the microstrip patch antenna access, the tuned frequency is obtained at 1638 MHz (see curve 22 in FIG. 5), i.e. at less then 1% offset from the "patch"-only frequency, and the corresponding matching bandwidths are:

to −10 dB: 31.5 MHz to −15 dB: 16.9 MHz;

for the dipole antenna access, the resulting tuned frequency is 2446 MHz (see curve 23 in FIG. 6) giving an offset of much less than 1% relative to the dipole on its own, and the matching bandwidths are:

to −10 dB: 236 MHz to −15 dB: 122 MHz.

In both cases, the differences between two band operation and nominal operation are minor with respect to:

locations of the tuned frequencies (offset $\leqq 1\%$);

stability of frequency matching performance.

Figure 7:
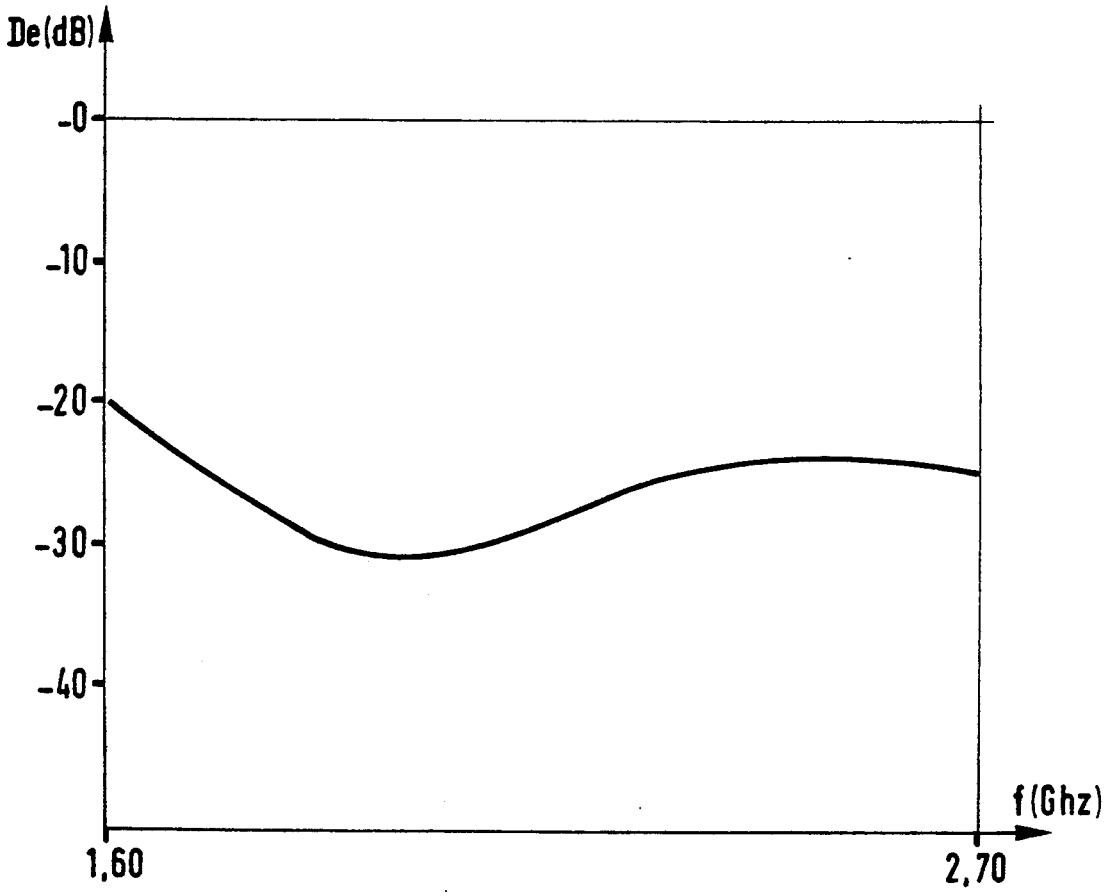
FIG. 7 is a curve showing inter-element decoupling as a function of frequency for the embodiment shown in FIG. 3.

In addition, the inter-element decoupling De checks out at being always greater than 20 dB, thus showing that each antenna has little effect on the other (see FIG. 7).

Checks on radiation pattern sections also show that there is no major deviation or impact between the nominal element (each antenna taken on its own) and the two-band element.

The dielectric substrate is relatively thin and its thickness depends on the nature of the dielectric material used: using a Kevlar "honeycomb" structure, the thickness is always $\leqq 10$ mm, and for dielectric materials having a higher constant, the thickness need not exceed a few millimeters (2 mm to 3 mm being typical for $\epsilon_r \approx 2.5$).

Figure 4:
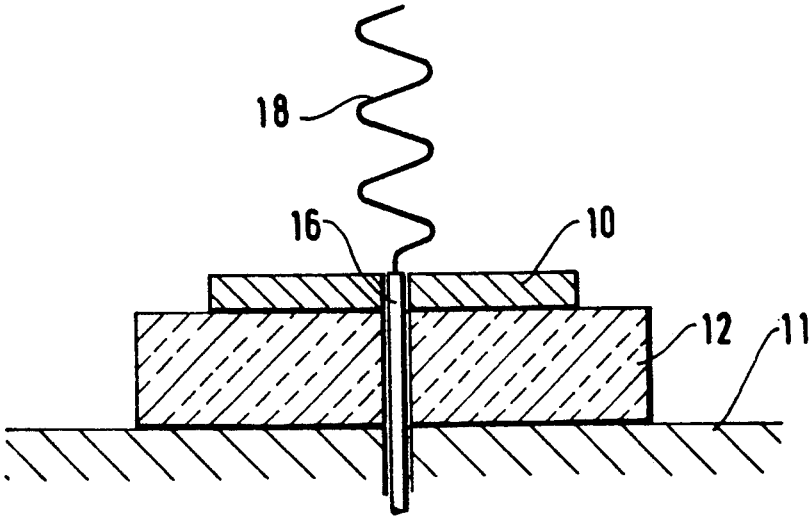
FIG. 4 is a section view through another embodiment of an antenna in accordance with the invention.

In another embodiment as shown in FIG. 4 the coaxial cable 16 passing through the hole 15 is terminated by a helical antenna 18.

Naturally the present invention has been described and shown merely by way of preferred example, and its component parts could be replaced by others without thereby going beyond the scope of the invention.

Thus, other types of antenna may be associated with a microstrip antenna, and the same radiating surface can still be used.

Naturally, the microstrip antenna need not be plane in shape, and it may be provided with a degree of curvature (cylindrical, spherical, . . . ), depending on its particular location on a structure: for example it may be located on a concave surface.

We claim:

1. A multifrequency antenna structure comprising: a microstrip patch first antenna (10, 11, 12) including a radiating surface (10) and a ground plane (11) and operating at one frequency, and a separately fed, wire type, dipole, second antenna (17) disposed in front of the first antenna radiating surface and said ground plane, and operating at a second different frequency, and wherein the first antenna (10, 11, 12) comprises a dielectric substrate (12) on said ground plane (11) and a metal top conductor (10) deposited on said dielectric substrate forming said radiating surface, a through hole passes through said dielectric substrate and the center of symmetry of said metal top conductor, a feedine for said wire type, dipole, second antenna passes through said first antenna via said through hole (15) and wherein the ground plane (11) of the first antenna is parallel to said second antenna.

2. A multifrequency structure antenna according to claim 1, characterized in that the second antenna is fed with a coaxial cable (16) which terminates in said dipole, second antenna (17).

3. A multifrequency structure antenna according to claims 1 or 2, wherein the first antenna top conductor (10, 11, 12) occupies a flat plane.

* * * * *